United States Patent [19]

Sandifer

[11] Patent Number: 4,688,802

[45] Date of Patent: Aug. 25, 1987

[54] BOARD GAME

[76] Inventor: John W. Sandifer, 2001 Golfway #112, St. Charles, Mo. 63301

[21] Appl. No.: 659,561

[22] Filed: Oct. 10, 1984

[51] Int. Cl.[4] ..... A63F 3/02

[52] U.S. Cl. ..... 273/261; 273/284

[58] Field of Search ..... 273/261, 262, 260, 258, 273/255, 284, 265

[56] References Cited

U.S. PATENT DOCUMENTS

| | | | |
|---|---|---|---|
| 498,451 | 5/1893 | Sovereign | 273/260 |
| 821,111 | 5/1906 | Miller | 273/262 |
| 1,295,878 | 3/1919 | Flagg | 273/262 |
| 1,713,455 | 5/1929 | Stickney | 273/262 |
| 2,379,465 | 7/1945 | Vollmer | 273/284 |
| 2,703,713 | 3/1955 | Moyer | 273/262 |
| 3,843,130 | 10/1974 | Whitney | 273/261 |
| 3,917,273 | 11/1975 | Blakewood | 273/261 |
| 4,126,315 | 11/1978 | Tung | 273/284 |

FOREIGN PATENT DOCUMENTS

| | | | |
|---|---|---|---|
| 2375885 | 9/1978 | France | 273/262 |

*Primary Examiner*—Richard C. Pinkham
*Assistant Examiner*—Matthew L. Schneider
*Attorney, Agent, or Firm*—J. Joseph Muller

[57] ABSTRACT

A game (1) for two players has as its object the entrapment of a particular playing piece of one player by a playing piece or pieces of the other player. A game board (3) is divided into a plurality of individual spaces. A plurality of individual playing pieces are distinctively identified to form two sets (5 and 5') of pieces. The pieces are manuverable between spaces on the game board to capture pieces of the other set. Movement of pieces is governed by a set of rules. An overlay (11 or 11') is placeable over a portion of the game board by a player. The overlay is divided into spaces corresponding to the spaces on the game board. Two sets of barrier pieces are provided, one set for each player. Each set includes barrier pieces (17 or 17') a player may position on his overlay. The barrier pieces establish barriers around and over which playing pieces of both players must be manuvered during the game. The game also includes representations of the game board such that each player possesses one of the representations. The representations are similar to the game board except that they contain marked spaces. The marked spaces represent areas on the board on which players can place pieces that have been previously captured.

6 Claims, 13 Drawing Figures

BOARD GAME

BACKGROUND OF THE INVENTION

This invention relates generally to board games and more particularly to board games of the type played by two players, each of whom has a set of playing pieces, with the object of the game being the entrapment of a particular playing piece of one player by the other player.

Board games come in many varieties, involve any number of players, and require various degrees of skill by the players. The most well-known board games are chess and checkers, both of which are designed for two players. Further, both of these games utilize sets of game pieces: in chess, the sets of game pieces include various distinctive pieces; while in checkers, all the game pieces in a set are alike. In both games, the pieces are manuvered or moved between spaces laid out on the game board in accordance with an established set of rules. While these games are fun to play and, in many instances, require a high degree of playing skill in order to win, there is, nevertheless, a sameness to each game. This is because the board layout for each game is always the same, and while this does not make these games any the less fascinating to their afficiandos, it can make them boring to others. What is desirable, is a board game that permits variability between games while staying within certain overall confines, so each game can be different from preceding ones while, at the same time, not requiring the players to know more than a few rules.

SUMMARY OF THE INVENTION

Among the several objects of the present invention may be noted the provision of a board game for two players in which each player manuvers a set of playing pieces over a game board in accordance with an established set of rules with the object of entrapping a particular playing piece of the opposing player; the provision of such a board game in which the board layout can be varied by the players from game to game thereby making the set-up for each game unique while, at the same time, not so complicating the game as to lessen interest in it; the provision of such a game in which various playing pieces in each set of pieces have distinctive movement capabilities; the provision of such a game in which the movement capabilities of certain of the playing pieces are similar to those of playing pieces in games such as chess, while the movement capabilities of other playing pieces have no equivalent in such other games; the provision of such a game which allows the exchange of captured pieces thereby reducing the possibility of drawn games; the provision of such a game utilizing a game board which includes offset spaces as an integral part of the board; and, the provision of such a game which is easy to learn, fun to play, and a challenge to players of all levels of ability.

Briefly, the present invention is a game for two players having as its object the entrapment of a particular playing piece of one player by a playing piece or pieces of the other player. The game comprises a game board divided into a plurality of individual spaces. A plurality of individual playing pieces are distinctively identified to form two sets of pieces with different pieces within each set being distinguishable from various other pieces within the same set. Each piece in each set is manuverable between spaces on the game board to capture pieces of the other set. Movement of the pieces is governed by an established set of rules. A pair of overlays, one for each player, is placed over a portion of the game board by a player. Each overlay is divided into a plurality of spaces corresponding in size, shape and arrangement to the spaces on the game board so to be in registry therewith when an overlay is placed over the game board. Two sets of barrier pieces are provided, one set for each player. Each set includes a plurality of barrier pieces one or more of which a player may position on spaces on his overlay. The barrier pieces establish barriers around and over which playing pieces of both players must be manuvered throughout the game. Other objects will be in part apparent and in part pointed out hereinafter.

BRIEF DESCRIPTION OF THE DRAWINGS

Corresponding reference characters designate corresponding parts throughout the several views of the drawings.

DESCRIPTION OF A PREFERRED EMBODIMENT

Figure 1:
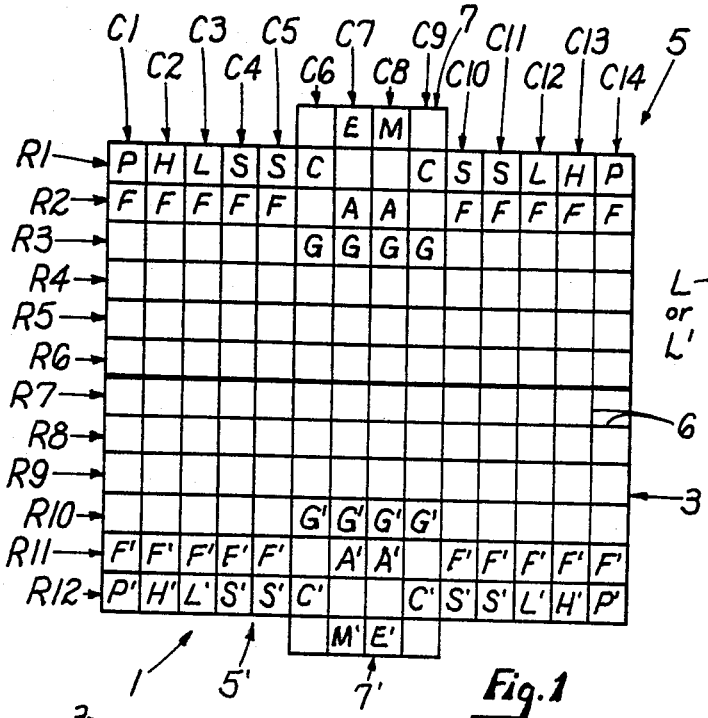
FIG. 1 is a representation of a game board for the game of the present invention depicting an initial arrangement of game pieces prior to the start of a game.

Referring to the drawings, a game for two players is indicated generally 1 in FIG. 1. Game 1 is played on a game board 3 which will be described in more detail hereinafter. Each player or participant has a set 5 or 5' of playing pieces which are manuvered or moved over the game board in accordance with an established set of rules. The object of the game is for one of the players to entrap or "touch" a particular playing piece of the other player. When one of the players does this, he wins the game. If neither player is able to do so, the game is a "draw".

As shown in FIG. 1, game board 1 comprises a generally rectangular board. Grid lines 6 (only two of which are indicated in FIG. 1 for the sake of drawing convenience) demarcate the game board into twelve rows, designated R1–R12, and fourteen columns, designated C1–C14. Also, the grid lines define distinct areas or spaces on the game board. Alternate spaces on the game board may, for example, be of different colors. In addition, the game board includes two offset portions 7 and 7'. These offset portions (each of which is referred to as a "Royal Court") are each one row deep by four columns wide and are arranged on opposite sides of the game board in alignment with each other. As a result, the game board has one-hundred seventy-six (176) spaces over which the various game pieces can be moved.

The sets 5 and 5' of game pieces each comprise thirty (30) individual pieces. The following is a list of the name, designation and number of the pieces comprising each set:

| NAME | DESIGNATION | NUMBER |
|---|---|---|
| EMPEROR | E or E' | 1 |
| EMPRESS | M or M' | 1 |
| CENTURIAN | C or C' | 2 |
| SENTINEL | S or S' | 4 |
| GENERAL | L or L' | 2 |
| CAVALRYMAN | H or H' | 2 |
| CAPTAINS | P or P' | 2 |
| ASSASSINS | A or A' | 2 |
| FOOT SOLDIER | F or F' | 10 |
| GLADIATOR | G or G' | 4 |

The game pieces comprising each set are distinctively formed in any appropriate manner so each different piece is readily distinguishable from the various other game pieces comprising the set. Similarly, the game pieces comprising one set are, for example, a different color from the game pieces comprising the other set so the different sets are also readily distinguishable. Further, the game pieces comprising each set may be color coded to identify the piece as being from the emperor's side of the board (i.e. placed in column C1–C7 if from set 5) or the empress' side of the board (i.e. placed in column C8–C14 if from set 5). Such code may, for example, be a colored band painted on the pieces.

The initial set-up of the game pieces on the game board, prior to the start of a game, is as shown in FIG. 1. Each player arrays his pieces in three ranks on the main portion of the game board. The gladiators G or G' occupy the four middle spaces in the respective first ranks (rows R3 and R10) and are the only pieces in that rank. The assassins A or A' respectively occupy the two middle spaces in the second rank (rows R2 and R11). There is an open space to the outside of each assassin and the five remaining spaces from there to the side of the game board are each occupied by a foot soldier F or F' respectively. The outermost spaces at each end of the third rank (rows R1 and R12) are occupied by captains P or P' respectively. Moving inwardly from these outermost spaces toward the center of the game board, the successive spaces are respectively occupied by a cavalryman H or H', a general L or L', a sentinel S or S', another sentinel S or S', and a centurian C or C'. The two middle spaces in the third rank are both unoccupied. The offset spaces on each side of the board constitute a fourth rank. The two outer spaces in these respective fourth ranks are unoccupied. The emperor E or E' and the empress M or M' occupy the two middle spaces and are arranged such that the emperor E of one player is opposite the empress M' of the other player (i.e. both are in column 7 on their respective sides of the board) and the empress M of the one player is opposite the emperor E' of the other player (i.e. both are in column 8).

The movement capabilities of the respective game pieces will now be described. For this purpose, it will be understood that forward or backward movement of a game piece means movement of that piece from one row to another while staying in the same column, and side-to-side movement means movement of that piece from one column to another while staying in the same row. Diagonal movement means movement in any forty-five degree direction to the present position of the piece.

Figure 2:
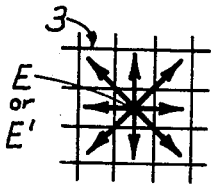

Referring to FIG. 2, the emperor E or E' may move one space in any direction from the space he currently occupies. If an adjoining space is occupied by a piece of the opposing player, he may capture that piece by moving to the space occupied by it. However, he cannot jump over other pieces, nor can he move to a space which would cause him to be entrapped or touched or "checkmated" by an opponent's piece. Entrapment of the emperor of one player by a piece or pieces of the other player signals the end of the game with the player who entrapped the other player's emperor winning.

Figure 3:
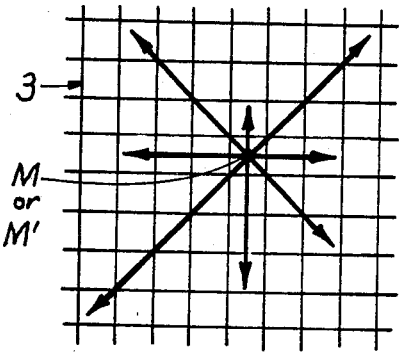

Referring to FIG. 3, the empress M or M' can move any number of spaces either forward, backward, side-to-side, or diagonally. In this respect, this is the most versatile game piece of either player. The empress, however, cannot jump over other pieces, nor can she re-enter the Royal Court once she has left it, even to capture an opponent's piece. She captures the other player's pieces by landing on the spaces they occupy.

Figure 4:
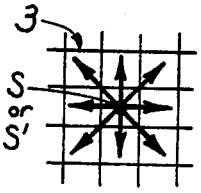

As shown in FIG. 4, the sentinel S or S' can move one space in any direction. He cannot jump over other game pieces. Further, the sentinel cannot capture other game pieces nor be captured itself. In addition, the sentinel is the only playing piece, other than the emperor and empress pieces, which may move into the offset spaces comprising the Royal Court. Also, the sentinel pieces cannot cross the center line of the game board. Thus, as shown in FIG. 1, the sentinel pieces S cannot move past row R6 while the sentinel pieces S' cannot move past row R7. The main function of this game piece is to protect, or serve as a bodyguard, for the emperor piece. As such, the sentinel piece represents a mobile barrier which can be interposed between the emperor piece and any opposing piece to block the path between that piece and the emperor piece. Since a sentinel piece cannot be captured, the space it occupies cannot be taken over by a playing piece of the opponent, all of which effects the opponent's strategy.

Figure 5:
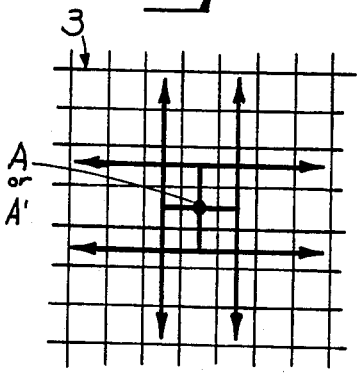

FIG. 5 illustrates the movement capabilities of the assassin A or A' pieces. The assassin can move one space forward, backward, or side-to-side and then three spaces in a direction at right angles to the original direction of movement. The piece cannot move in a diagonal direction, but can jump over other game pieces. The assassin captures an opposing player's piece by landing on the space occupied by that piece. An important feature of the assassin piece is that any opposing player's piece captured by it is permanently removed from the game even though there are provisions, to be described hereinafter, by which the players may otherwise exchange captured pieces and reintroduce them into the game. There are three exceptions to assassin's capture capability. These are: (1) the emperor cannot be captured by the assassin, (2) the sentinel cannot be captured by the assassin, and (3) the empress cannot be captured by the assassin when she occupies any of the four spaces comprising the offset portion (the "Royal Court") on her side of the game board. However, once the empress piece is moved out of the Royal Court, it is subject to capture by the assassin.

Figure 6:
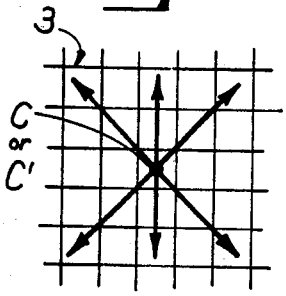

The movement capability of the centurion C or C' is shown in FIG. 6. This piece may move two spaces forward, backward, or diagonally, but cannot move side-to-side. The centurion may jump over other pieces and captures an opponent's piece by landing on the space occupied by that piece.

Figure 7:
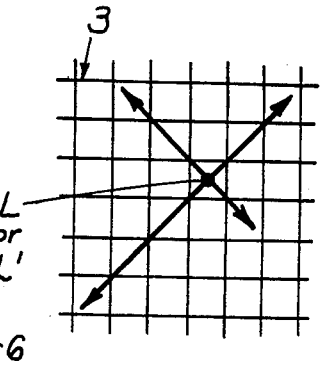
FIGS. 2–11 are representations of a portion of the game board on which are illustrated the movement capabilities of the various pieces comprising a set of game pieces for each player.

Referring to FIG. 7, the general pieces L or L' are shown as being capable of moving in the diagonal directions only. They may move any number of spaces in a diagonal direction but cannot jump over other pieces. They capture a piece by landing on the space that piece occupies. Typically, when game board 3 has alternately colored spaces, one general piece of each set will initially be placed on a space of one color and will only move on spaces of that color; while, the other general piece in the set will initially be placed on and will only move on spaces of the other color.

Figure 8:
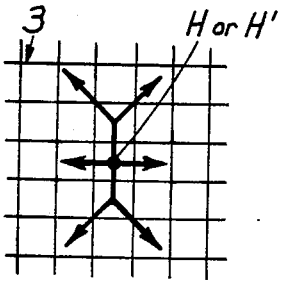

FIG. 8 illustrates the movement capability of the cavalryman pieces H or H'. As shown, this piece moves one space in either the forward or backward and then one space diagonally in the same general direction as his initial move. The piece can also be said to move two spaces forward or backward and then one space in a right angle direction to the direction of original movement. In either event, the cavalryman may jump over pieces blocking his path. The cavalryman has an optional movement capability, also shown in FIG. 8, of moving one space side-to-side. However the piece is moved, it captures other pieces by landing on the space they occupy.

Figure 9:
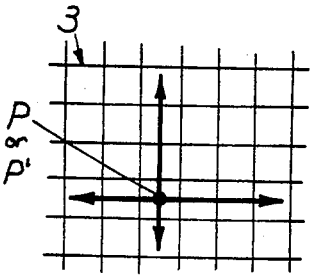

The captain pieces P or P' may, as shown in FIG. 9, move in a forward, backward, or side-to-side direction. The captain may move as many spaces as a player wishes to move him; however, he can only move in one direction at a time, and cannot jump over other pieces. This piece captures other pieces by moving onto the space they occupy.

Figure 10:
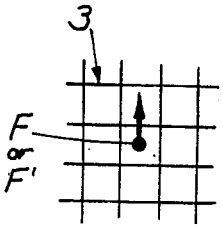

FIG. 10 illustrates the movement capability of the feed soldier pieces F or F'. These pieces may normally move only one space in a forward direction. However, the first time a particular foot soldier piece is moved, it may be moved one, two, or three spaces forward. The foot soldier captures other pieces by moving diagonally onto the space that other piece occupies. If a foot soldier encounters a barrier piece (to be described hereinafter) which prevents its further movement in a column, the piece may be moved or shifted one space, left or right, to clear the barrier piece and thereafter move in the column to which it has been shifted. If a foot soldier is moved from his starting rank (row R2 or R11 respectively) across game board 3 to the other end of the game board (i.e. to row R12 or R1 respectively), the piece can be replaced or exchanged for any other game piece of the same set which has been previously captured. As discussed previously, this would not include a game piece captured by an assassin since, as noted, these pieces cannot be reintroduced into the game.

Figure 11:
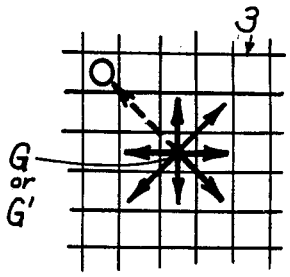

The movement capability of the gladiator game pieces G or G' is shown in FIG. 11. These pieces normally move one space in a forward, backward, side-to-side or diagonal direction and capture an opposing piece by a one space move forward, forward diagonally, or side-to-side and landing on the space it occupies. Further, to capture an opposing piece, the gladiator can also move or "lunge" an additional space in the forward direction or in either forward diagonal direction (see the dashed line indication of movement in FIG. 11). The gladiator piece thus can use its "lunge" capability to capture a piece in front of it but it can never capture a piece which is more than one space to the side of it or which is behind it.

With the above described movement capabilities of the pieces comprising the two sets, and with the initial set-up of the game pieces as shown in FIG. 1, the player with the darker colored playing pieces has the first move and can begin a game. The players manuver their game pieces over the game board, capturing opponent pieces until one player is unable to move his emperor piece without being checkmated or touched by one or more of the opponent's game pieces. At that point, the player who has placed his opponent's emperor piece in this jeopardy is the winner of the game. If, however, neither player is able to place his opponent's emperor piece in checkmate, and, if both players agree that neither will be able to trap or checkmate the other's emperor, the game is a draw with neither player winning. The players may, at an agreed point during the game, decide the game will be a draw if neither is able to trap or checkmate the other's emperor after an agreed upon number of additional moves by either or both players. The players can also agree, prior to the start of the game, to limit the total number of moves each shall have during the game.

Play of the game is also controlled by the following rules:

(1) A player cannot move one of his game pieces onto a space already occupied by another of his game pieces;

(2) A player initiates a move by touching his game piece in order to move it. If a player touches one of his game pieces and then releases it without moving it, it constitutes his move;

(3) A player cannot touch his opponent's game piece unless his is capturing it with one of his own game pieces;

(4) Neither player can move one of his game pieces into the offset spaces (the Royal Court) on his side of the board. As noted previously, the only pieces of a player which may occupy spaces on the offset portion on his side of the game board are the emperor and empress (which are positioned there at the start of the game) and the player's sentinel pieces. Either player can, however, attack and occupy the offset spaces on his opponent's side of the board.

It is another feature of the game that players may exchange previously captured pieces. This is done to help reduce drawn games. Such an exchange is allowed once during the game with the players being allowed to exchange up to four pieces. The combination of pieces exchanged is as agreed upon by the players and therefore may, for example, be a one-for-one exchange of comparable pieces, or a two-for-one exchange of different pieces, etc. Exchanged pieces, as previously noted, cannot include pieces capture by the opponent's assassin pieces.

Figure 13:
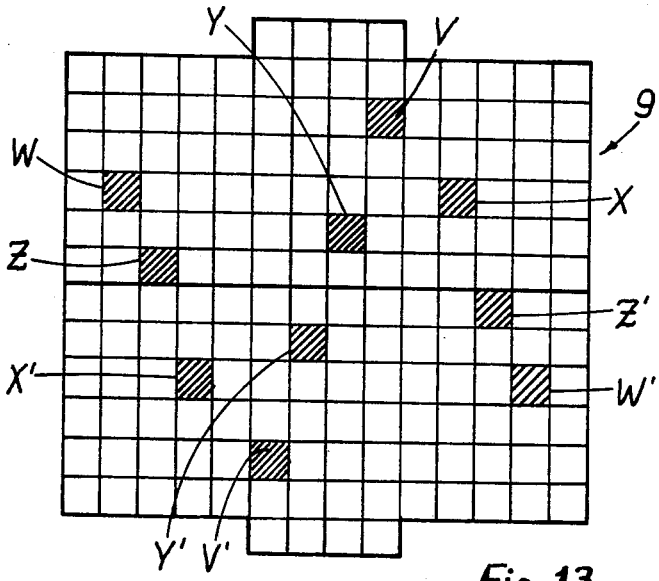

Exchanged pieces are brought back into play in the following manner: The players use a sheet 9, see FIG. 13, on which is printed a representation of the game board with all its spaces. Five spaces V, W, X, Y and Z are marked on one side of the representation and five corresponding spaces V', W', X', Y' and Z' are marked on the other side. After the players have determined which pieces will be exchanged, each player indicates which of the five designated spaces on his side of the board an exchanged piece will occupy and which exchanged piece it will be. If a designated space is already occupied at the time of the exchange (either by the player's own piece or by his opponent's piece) that space cannot be used. Each player has his own sheet 9 which he marks in secret and then exchanges with the other player. No change in placement can be made after the exchange of sheets.

Figure 12:
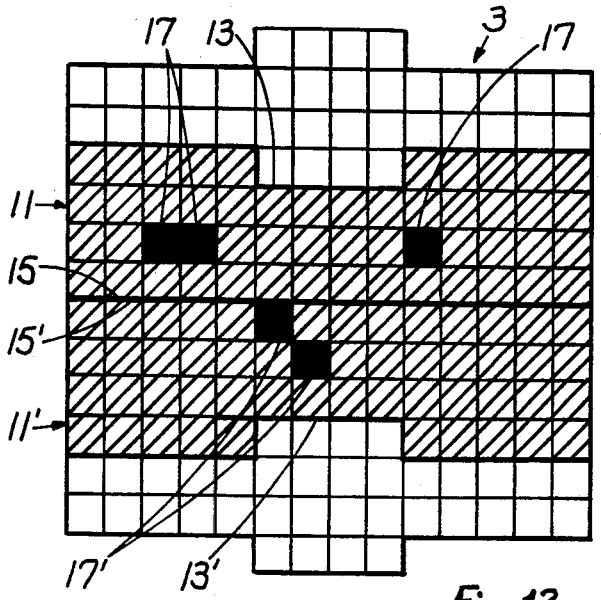
FIG. 12 is a representation of the game board and overlays used by each player to change the layout of the gameboard so each board layout may differ from preceding layouts; and, FIG. 13 is a representation of the game board with specific spaces demarcated for determining where on the actual game board exchanged pieces will be placed by the players.

It is an important feature of the present invention for the players to be able to alter the layout of the game board from game to game so to provide more variety to the game. For this purpose, and as shown in FIG. 12, each player is provided an overlay 11 or 11'. Each overlay corresponds in width to the width of the game board (i.e. it is fourteen columns wide). Further, each overlay is four rows long at each end with an inset (13 and 13' respectively) in the middle which is one row deep and four columns wide. The overlays each contain grid lines corresponding to the grid lines 6 on the game board so to define spaces comparable in size, shape, and arrangement to the spaces on the game board. Each player places his overlay on the game so the respective leading edges 15 and 15' thereof align with the grid line separating row R6 from row R7 (this line marking the centerline of the game board). When properly placed, the spaces on the overlays are in registry with their corresponding spaces on the game board.

Once the players have positioned their overlays on the game board, they next decide whether or not to place barrier pieces (17 or 17' respectively) on their respective overlays. Each player has four barrier pieces which he can position on any of the spaces on his overlay. Each barrier piece is sized to fully occupy a space on which it is positioned and each player has the option of using none, one, two, three, or all four of his barrier pieces. The only rule governing placement of barrier pieces is that no more than two barrier pieces may be adjoining whether arranged in a row, a column, or diagonally. It should be noted that the players must decide in advance of a game whether or not to use the overlays and barriers, and the barriers must be positioned prior to the start of play. The players make their placement determination in secret. Once a game has commenced, the barrier pieces cannot be moved. To prevent accidental dislodgement of a barrier piece, the overlays may, for example, be of a thickness sufficient for holes or perforations (not shown) to be made in each space on the overlay with the barrier pieces having a post or stem (also not shown) insertable into the holes. Two alternatives to this method are also available: first, overlays 17 and 17' may be incorporated with sheet 9 as, for example, a shaded area on the sheet corresponding to the hatched spaces shown in FIG. 12. Second, holes or perforations may be made in the appropriate spaces on game board 3 so the barrier pieces can be set into the game board without the need of an overlay.

The barrier pieces act as impediments to the manuverability of the various game pieces. If a game piece's movement capability does not allow it to jump over other game pieces, it cannot jump over a barrier piece. Also, none of the game pieces can occupy a space occupied by a barrier piece. As a consequence, the players must alter their strategies for moving their various game pieces to account for the barriers which, depending on how a player plays, can impede the movement of his game pieces or provide a shelter to prevent capture of his game pieces by his opponent.

In view of the foregoing, it will be seen that the several objects of the invention and other advantageous results are attained.

As various changes could be made in the above without departing from the scope of the invention, it is intended that all matter described herein and shown in the accompanying drawings be interpreted as illustrative only and not in a limiting sense.

What is claimed is:

1. A game for two players having as its object, the entrapment or as touching of a particular playing piece of one player by a playing piece or pieces of the other player, the game comprising:

a board divided into a plurality of individual spaces delineated by grid lines marked on the board;

a plurality of individual playing pieces distinctly identified to form two sets of playing pieces, different pieces within each set being distinguishable from various other playing pieces within the set, the different pieces comprising each set being manuverable between spaces on the game board to capture pieces of the other set with a captured piece being removed from the board, movement of the various pieces being in accordance with a set of rules which also allows the exchange of captured pieces between the players with the exchanged pieces being returned to the board; and two representations of the game board, one representation for each player, each representation being separate from the game board and from the other representation, each representation having grid lines thereon corresponding to the grid lines on the game board so to delineate spaces on the representation corresponding to all the spaces on the board, each representation having predetermined spaces permanently marked thereon, so as to differentiate them from the rest of the spaces, the marked spaces on one representation being in the same location as the marked spaces on the other representation whereby each player prior to putting any playing pieces received in an exchange of playing pieces back into play, indicates to the other player, on his respective representation, on which game board spaces the exchanged playing pieces will be placed.

2. The game of claim 1 further including two sets of barrier pieces, one for each player, each set having one or more barrier pieces which a player may position on spaces on his side of the game board, the barrier pieces establishing barriers around and over which playing pieces of both players must be manuvered throughout the game.

3. The game of claim 2 wherein the gam board includes a plurality of offset spaces on opposite sides of the board, the respective offset spaces on each side of the board being adjoining spaces at least one of which is occupied by a game piece of the respective player's set of game pieces at the start of the game.

4. The game of claim 3 wherein each set of playing pieces includes at least ten different types of playing pieces, each type having different movement capabilities as defined by the rules of the game.

5. A game for two players having as its object the entrapment or touching a particular playing piece of one player by a playing piece or pieces of the other player, the game comprising:

a game board divided into a plurality of individual spaces delineated by grid lines marked on the board;

a plurality of individual playing pieces distinctly identified to form two sets of playing pieces, different pieces within each set being distinguishable from various other playing pieces within the set, the different pieces comprising each set being manuverable between spaces on the game board to capture pieces of the other set with a captured piece being removed from the board, movement of the various pieces being in accordance with a set of rules which allows the exchange of captured pieces between the players with the exchanged pieces being returned to the board;

two representations of the game board, one representation for each player, each representation being separate from the game board and from the other representation, each representation having grid lines thereon corresponding to the grid lines on the game board, each representation having predetermined spaces permanently marked thereon, so as to differentiate them from the rest of the spaces, the marked spaces on the one representation being in the same location as the spaces marked on the other representation, whereby each player, prior to putting any playing pieces received in an exchange of playing pieces back into play, indicates to the other player, on his respective representation, on which game board spaces the exchanged playing pieces will be placed; and, a pair of overlays, one for each player, each overlay being placeable over a portion of the game board by a player, each overlay being divided into a plurality of spaces corresponding in size, shape and arrangement to the spaces on the game board so be in registry therewith when a respective overlay is properly placed over the game board.

6. The game claim of 5 further including two sets of barrier pieces, one for each player, each set of barrier pieces including a plurality of barrier pieces one or more of which a player may place on his side of the game board to establish barriers around and over which playing pieces of both players must be manuvered throughout the game with each player indicating on his overlay where he will place his barrier pieces.

* * * * *